US005335453A

United States Patent [19]

Baldy et al.

[11] Patent Number: 5,335,453

[45] Date of Patent: Aug. 9, 1994

[54] POLISHING MACHINE HAVING A TAUT MICROABRASIVE STRIP AND AN IMPROVED WAFER SUPPORT HEAD

[75] Inventors: André Baldy, Seyssins; Gérard Barrois, Le Fontanil; Henri Blanc, Saint Julien de Ratz; Marcel Dominiak, Grenoble, all of France

[73] Assignee: Commissariat a l'Energie Atomique, Paris, France

[21] Appl. No.: 127,120

[22] Filed: Sep. 27, 1993

Related U.S. Application Data

[63] Continuation of Ser. No. 893,057, Jun. 3, 1992, abandoned.

[30] Foreign Application Priority Data

Jun. 6, 1991 [FR] France ..... 91 06866
Jun. 6, 1991 [FR] France ..... 91 06869

[51] Int. Cl.[5] ..... B24B 21/04; B24B 7/22

[52] U.S. Cl. ..... 51/67; 51/62; 51/283 R

[58] Field of Search ..... 51/283 R, 148, 119-120, 51/145 R, 62, 67, 235

[56] References Cited

U.S. PATENT DOCUMENTS

| | | | |
|---|---|---|---|
| 3,777,442 | 11/1973 | Bernu | 51/148 |
| 3,794,314 | 2/1974 | Coburn | 51/217 L |
| 3,924,361 | 12/1975 | White | 51/120 |
| 3,971,163 | 7/1976 | Trombley et al. | 51/62 |
| 4,612,733 | 9/1986 | Lee | 51/119 |
| 4,640,687 | 2/1987 | MacCarthy | 51/148 |
| 4,759,152 | 7/1988 | Berger | 51/119 |
| 4,858,265 | 8/1989 | Suzuki | 51/135 R |
| 5,133,156 | 7/1992 | Arms | 51/148 |
| 5,148,639 | 9/1992 | Sakai | 51/142 |
| 5,193,316 | 3/1993 | Olmstead | 51/283 R |

FOREIGN PATENT DOCUMENTS

| | | | |
|---|---|---|---|
| 0349653 | 1/1990 | European Pat. Off. . | |
| 2637343 | 2/1978 | Fed. Rep. of Germany . | |
| 2903962 | 8/1980 | Fed. Rep. of Germany | 51/145 R |
| 8717353 | 2/1989 | Fed. Rep. of Germany . | |
| 610327 | 2/1926 | France . | |
| 0001151 | 1/1984 | Japan | 51/145 R |
| 0688319 | 10/1979 | U.S.S.R. | 51/62 |

OTHER PUBLICATIONS

Patent Abstracts of Japan, vol. 8, No. 83, (M-290) (1520), Apr. 17, 1984, & JP-A-59 001 151, Jan. 6, 1984, Y. Ochiai, "Tape Polishing Device".

Patent Abstracts of Japan, vol. 14, No. 119, (M-945) [4062], Mar. 6, 1990, & JP-A-01 316 160, Dec. 21, 1989, Y. Yasuike, et al., "Polishing of Disk".

Patent Abstracts of Japan, vol. 15, No. 339, (M-115), Aug. 28, 1991, & JP-A-03 131 464, Jun. 5, 1991, Y. Hattori, et al., "Abrasive Tape Tension Control Device in Surface Polishing Device Using Abrasive Tape".

*Primary Examiner*—Robert A. Rose
*Attorney, Agent, or Firm*—Oblon, Spivak, McClelland, Maier & Neustadt

[57] ABSTRACT

A polishing machine having a taut microabrasive sheet. The machine includes a machine polishing disk in the form of a planar reference disk and a microabrasive sheet held taut on the disk by an appropriate mechanism. The mechanism for holding the microabrasive sheet taut can be a delivery roll and a receiving roll. The machine can be applied to the polishing of silicon wafers containing integrated components and in particular magnetic read-write heads.

14 Claims, 11 Drawing Sheets

POLISHING MACHINE HAVING A TAUT MICROABRASIVE STRIP AND AN IMPROVED WAFER SUPPORT HEAD

This application is a continuation of application Ser. No. 07/893,057, filed on Jun. 3, 1992, now abandoned.

BACKGROUND OF THE INVENTION

1. Field of the Invention

The present invention relates to a polishing machine having a taut microabrasive strip and to an improved wafer support head.

The invention more particularly applies to the polishing of integrated microelectronic components in semiconductor wafers (e.g. of silicon). It can in particular relate to magnetic read-write heads.

2. Discussion of the Related Art

Processes for producing such heads are described in numerous documents and in particular in U.S. application Ser. No. 4,837,924 and U.S. application Ser. No. 4,333,229. The first document relates to so-called horizontal structure heads formed from a stack of layers deposited on the upper face of a semiconductor wafer, while the second document relates to so-called vertical structure heads formed from layers deposited on the edge of such a wafer.

The micromachining operations performed on such wafers consist in the first case of levelling or planarizing and polishing various intermediate subassemblies obtained during the production process, defining a head gap and bringing the complete head into the general plane of the substrate, also known as the movement plane. In the second case, the micromachining operations aim at defining a head gap and at adjusting the shape of the movement shoes.

Although it could possibly apply to the construction of heads of the second category (vertical heads), the machine according to the invention is more particularly intended for the polishing of assemblies or subassemblies corresponding to the first category (horizontal heads), because it is in this case that the technical problems are the most difficult.

FIG. 1 shows as an example of a part to be polished a horizontal structure magnetic read-write head. The assembly shown corresponds to the final stage of production prior to the final polishing. The assembly comprises a silicon substrate 10 in which has been etched a recess, an iron-nickel alloy magnetic circuit 12, a double copper coil 14, a 3 to 6 μm thick silica layer 16, an approximately 1 μm thick amagnetic silica spacer 18 and two iron-nickel upper pole pieces. The plane of the final polishing is indicated in dotted line form and is designated 22.

The removal of the material relates to the pole pieces 20 and extensions 23 made from silica. In order not to bring about a deterioration of the magnetic circuit, the removal must not reduce the thickness of the uniform silica layer by more than 0.3 μm. The final polishing plane defines the movement plane of the head.

Two such heads are generally juxtaposed on parallel strips known as skis defining two movement planes in a generally catamaran-like structure.

The polishing operation, which consists of the removal of a very small material quantity is well known and is encountered in metallography, optics and microelectronics.

It is possible to use one or other of the two following procedures. The first consists of grinding with a diamond tool, where machining leads to a continuous or semi-continuous "shaving" by two relative combined movements between the tool and the part to be machined (an advance movement and a cutting movement). The second consists of grinding and polishing constituting a varyingly fine abrasion or cold-working of a controlled nature of the surface by rubbing on very varied disks, which are not abrasive by nature and to which an abrasive in paste or aqueous solution form has been applied. A variant consists of placing on a rotary polishing disk an abrasive film disk and spraying the latter during polishing with a liquid in order to cool the part and prevent dirtying.

The polishing of semiconductor wafers having a very large number of integrated microcomponents causes various problems. Firstly the wafer is deformed and deformable. The grinding operation must also affect simultaneously several materials of very different hardnesses such as silica, alumina, alumina/titanium carbide alloy and iron/nickel alloy. The parts to be ground have very small surfaces compared with the silicon wafer. Finally, it is a question of machining in their thickness layers deposited on a wafer and it is generally necessary to simultaneously polish 600 excrescences corresponding to 600 magnetic heads, which project by a few microns and this is necessary with an accuracy of approximately 1 nanometer, without reducing the thickness of the film covering the wafer by more than 200 to 300 nm.

The known polishing machines do not make it possible to satisfy all these requirements. In particular, the use of a liquid with abrasive grains or an abrasive film bonded to a support is not suitable, as is apparent in conjunction with FIGS. 2 to 6.

FIG. 2 illustrates the known principle of grinding with a liquid containing abrasive grains. The wafer 10 and its excrescences 25 are positioned facing a polishing disk 23 and the abrasive grain-containing liquid 24 forms a film between the wafer and the reference plane. The wafer translation movement leads to the abrasion of the excrescences.

However, complex hydrodynamic phenomena more particularly associated with the formation of whirling or turbulent movements around the excrescences and cavitation phenomena lead to a defective polishing, whose result is illustrated in FIG. 3. In FIG.. 3, part a shows an excrescence **25*a* before polishing and whose shape very substantially corresponds to that encountered in the case of integrated magnetic heads, as will be shown hereinafter. This profile assumes the shape 25*b* after the start of polishing (part b) and finally the shape 25*c*** (part c) at the end of polishing. It can be seen that the sought result has not been obtained, because the movement plane has been reached and peaks remain. In particular, soft materials are hollowed out more than hard materials.

Another known method consists of using a microabrasive plastic film bonded to a reference disk. FIG. 4 shows a reference disk 23 to which a microabrasive film 27 has been bonded by adhesive points 28 (aerosols). The adhesive coating has a thickness of approximately 100 μm. The sheet thickness is approximately 50 to 75 μm. Therefore the assembly has a thickness of approximately 150 to 175 μm.

FIG. 5 shows this abrasive means with a wafer 10 and its excrescences 25 to be polished. It is possible to see the presence of tile excrescences and the relatively great thickness of the polishing layer lead to a corregating or creasing of the latter due to local compression of the sheet and crushing of the adhesive points. Here again the final polishing obtained is not satisfactory. FIG. 6 shows in diagrammatic manner the profile of a polished shoe 29, prior to polishing (FIG. 6*a*) and after polishing (FIG. 6*b*).

Polishing machines are also known which make use of an abrasive film, which is not bonded to a reference surface, but is instead held taut above a disk. Such machines are described in DE-U-8 717 353 and DE-OS 26 37 343. These machines comprises a delivery roll or reel and a receiving roll or reel between which passes in a stepwise movement the microabrasive strip. The latter passes above a soft material part. The part to be polished, which is in this case a plate base, is held by a head performing a rotary movement. A pneumatic means located in the lower part of the machine makes it possible to engage the microabrasive strip below the plate base, so that the latter deforms the abrasive film and is embedded in the soft part. The tension of the strip is obtained by means of grippers or jaws, which simultaneously make it possible to bring about the stepwise strip advance.

Such a machine is not suitable for polishing semiconductor wafers for a number of reasons. Firstly, the embedding in the soft material is inadmissible for already indicated reasons, namely the reliefs would be rounded and deformed. Thus, it is necessary to work on a perfectly planar reference disk using a very thin microabrasive film in order to obtain the benefits of the flatness of the reference disk.

Moreover, although the polishing of plate bases allows the use of coarse abrasive grains, the polishing of semiconductor wafers requires much finer grains. However, with such grains, there is the phenomenon of the adhesion of the wafer to the abrasive film to the point that the separation of the wafer at the end of polishing requires the formation of an air wedge to permit the separation of the wafer. This phenomenon tends to cause corrugations on the microabrasive strip. To avoid this risk, it is necessary to make the microabrasive strip very taut over its entire length. However, this is not possible with the machine according to DE-U-8 717 353, which only has for this purpose handles (or jaws) gripping the sides of the strip. These means would lead to a certain tension on the edges of the strip, but not in the center and would also lead to risks of the strip tearing.

Moreover, with the prior art machine, it is not possible to continuously move the taut abrasive strip. Thus, the advance of the strip can only take place stepwise, because it is held taut by members which grip it.

The need to use very fine polishing grains and a very taut film, which leads to the adhesion of the wafer, causes other problems not solved by the machine described in DE-U-8 717 353 and DE-OS 26 37 343. Thus, in the case of such machines, the stone to be polished, namely a plate, is simply held in a support by a vacuum produced above the plate. Such a vacuum would have to be very high in order to hold the semiconductor wafer and would lead to the breaking of the latter.

Finally, a head performing a rotary movement like that of the aforementioned documents would not be suitable for the polishing of semiconductor wafers, because then the center of the wafer would not be polished. A simple rotary movement can only be suitable for circular parts, such as the base of plates.

SUMMARY OF THE INVENTION

The present invention aims at obviating the disadvantages. In this connection, the invention provides two types of arrangements.

The first type, associated with the use of a taut microabrasive strip, firstly provides for the strip being taut above a reference disk offering a rigid planar surface. It also provides special means for tensioning the strip between the delivery roll and the receiving roll without using handles, jaws or grippers, which makes it possible to keep the film taut over its entire width and in a uniform manner. This also allows a continuous movement of the strip for replenishment purposes.

The second arrangement is linked with the means for supporting the wafer and which are such that a circular translatory movement is obtained. This particular movement imposes on the abrasive strip forces, whose direction changes permanently (360° per revolution) and which are exerted both in the longitudinal direction (either in the displacement direction, or in the opposite direction) and in the transverse direction. These forces which would tend to cause corrugations in the strip require the latter to be perfectly taut. As the wafer is by its very nature deformable and deformed, a flexible material disk is placed at the rear of the wafer. Finally, a ball system makes it possible to have a rolling point as close as possible to the polishing plane, which reduces any unwanted torque in the circular translatory movement, which would be particularly prejudicial in the case of intense forces and loads imparted to the wafer for the displacement thereof.

All these means together solve the problems associated with the polishing of semiconductor wafers. Thus, in a polishing machine with a taut abrasive film, it is necessary to maintain the wide abrasive film (15 to 45 cm approximately) in very fine form (25 to 50 microns) taut without any corrugating effect (at approximately 10 to 50 kg approximately, i.e. 4 to 5 kg/mm$^2$ of strip cross-section). For example, for a width of 300 mm and a thickness of 25 $\mu$m, the tension will be 35 kg on a reference plane which is as long as the film is wide. The taut abrasive strip must be able to move continuously and very slowly (0.2 to 20 cm/minute), in a regulatable controllable manner and without jerking. These two operating conditions (tension and movement speed) must in no case be disturbed by the forces imposed on the strip by the sample to be polished. The latter, which performs a circular translatory movement, must be held in an appropriate support head able to take account of the deformation of the sample and able to prevent unwanted torques.

The microabrasive sheets, strips or films usable in the invention can be of a commercial nature, such as those marketed by 3M, whose 15 or 25 or 35 or 50 or 75 $\mu$m thick "film Imperial Lapping (ILF)" will be suitable, the film being available in roll form.

More specifically, the invention relates to a polishing machine which, like certain known machines, comprises:

a taut microabrasive strip above a disk between a delivery roll and a receiving roll, a support head able to keep a sample to be polished with the face to be polished facing the abrasive strip, characterized in that:

the disk offers a rigid, planar upper face, the delivery roll is equipped with means for exerting thereon a resistant torque and the receiving roll is controlled by a motor, the sample support head comprises a rigid part and a disk made from a flexible material and having a certain thickness, the disk being fixed to the rigid part and receives the wafer to be polished, the rigid part being connected by a self-aligning bearing and a vertical shaft to means for displacing the support head in a circular translatory movement.

BRIEF DESCRIPTION OF THE DRAWINGS

The invention is described in greater detail hereinafter relative to non-limitative embodiments and with reference to the attached drawings, wherein show.

DESCRIPTION OF THE PREFERRED EMBODIMENTS

Figure 7:
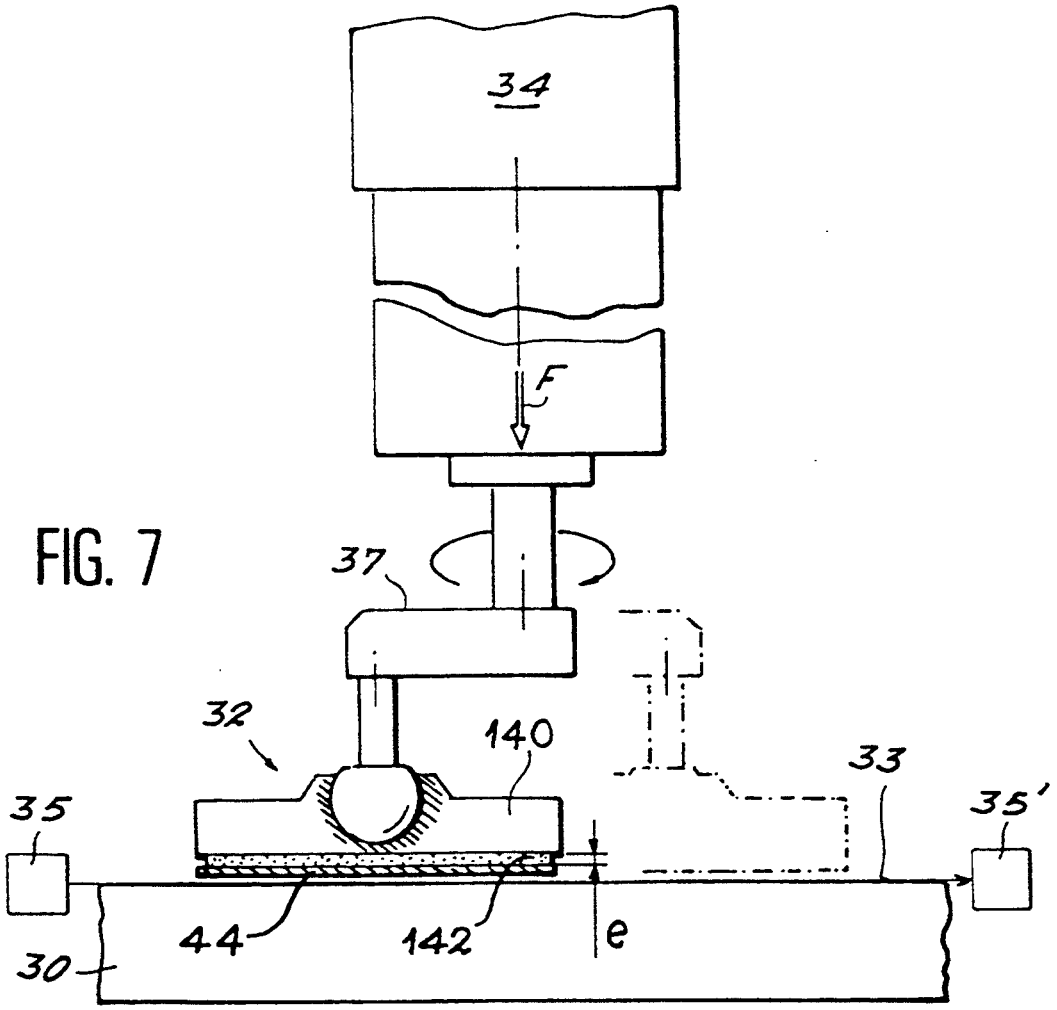
FIG. 7 The general arrangement of the machine according to the invention with a taut microabrasive sheet and a wafer support performing a circulatory translation.
Figure 2:
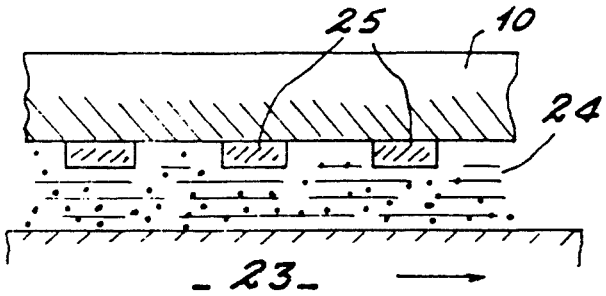
FIG. 2 Already described, the known principle of grinding with an abrasive grain-containing liquid film.
Figure 3:
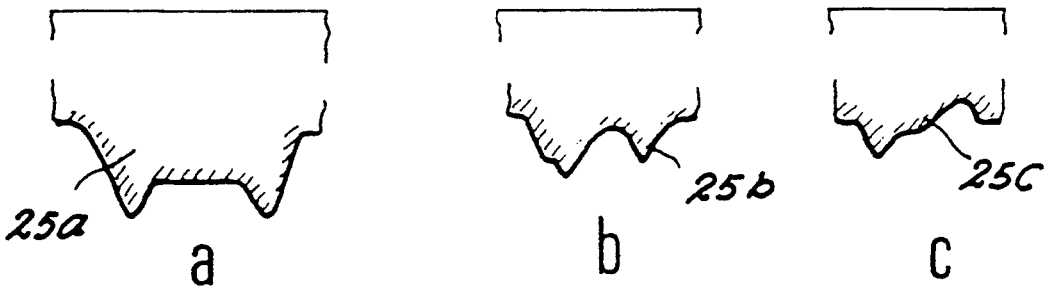
FIG. 3 Already described, the profile of a pattern during polishing performed by the aforementioned principle.
Figure 4:
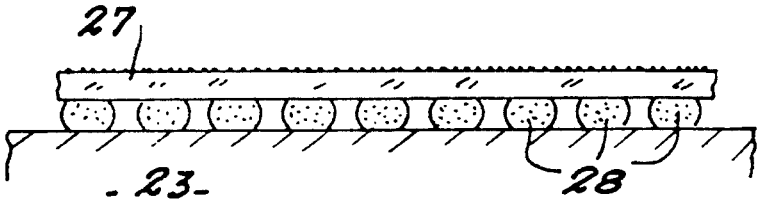
FIG. 4 Already described, the known principle of grinding with a microabrasive plastic film bonded to a reference disk.
Figure 5:
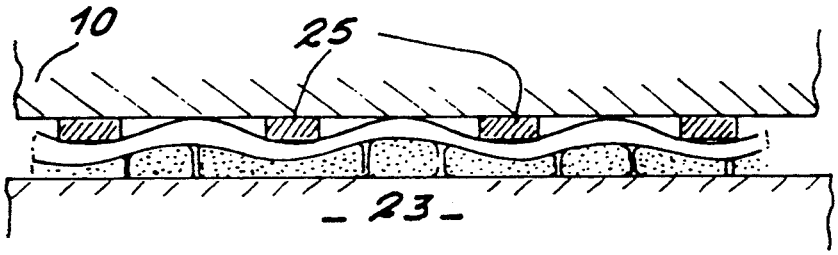
FIG. 5 Already described, the deformation undergone during polishing by a bonded microabrasive sheet.
Figure 6:
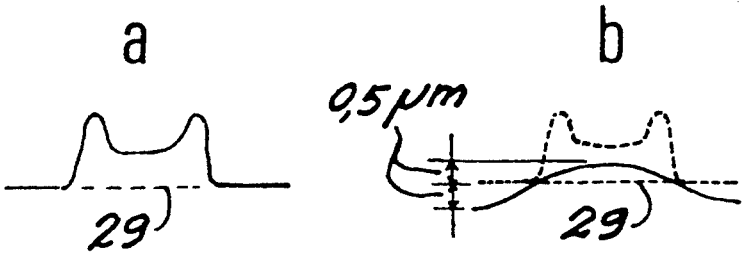
FIG. 6 Already described, the profile of a shoe polished by the procedure of FIGS. 4 and 5.

The machine shown in FIG. 7 comprises a fixed polishing disk 30, a sample support head 32 having a rigid part 140 and a flexible material disk 142, which has a certain thickness (e). The flexible disk diameter is substantially the maximum diameter covering the area of the plate covered by the excrescences to be polished. The disk 142 is fixed to the rigid part 140 and receives the wafer 44 to be polished. Therefore the wafer 44 is partly embedded in the thickness of the disk 142 during polishing by the effect of the force exerted on the support head. The flexible material of the disk 142 can be an elastomer. Means for exerting a force F on the support head 32 in order to apply the wafer 44 to be polished to the polishing disk 30 and for displacing the head relative to the said disk are provided and can be constituted by an eccentric 37.

The polishing means comprises a taut microabrasive strip or sheet 33 engaged against a reference disk 30. The sheet is kept taut by means 35, 35' on either side of the disk 30.

Figure 8A:
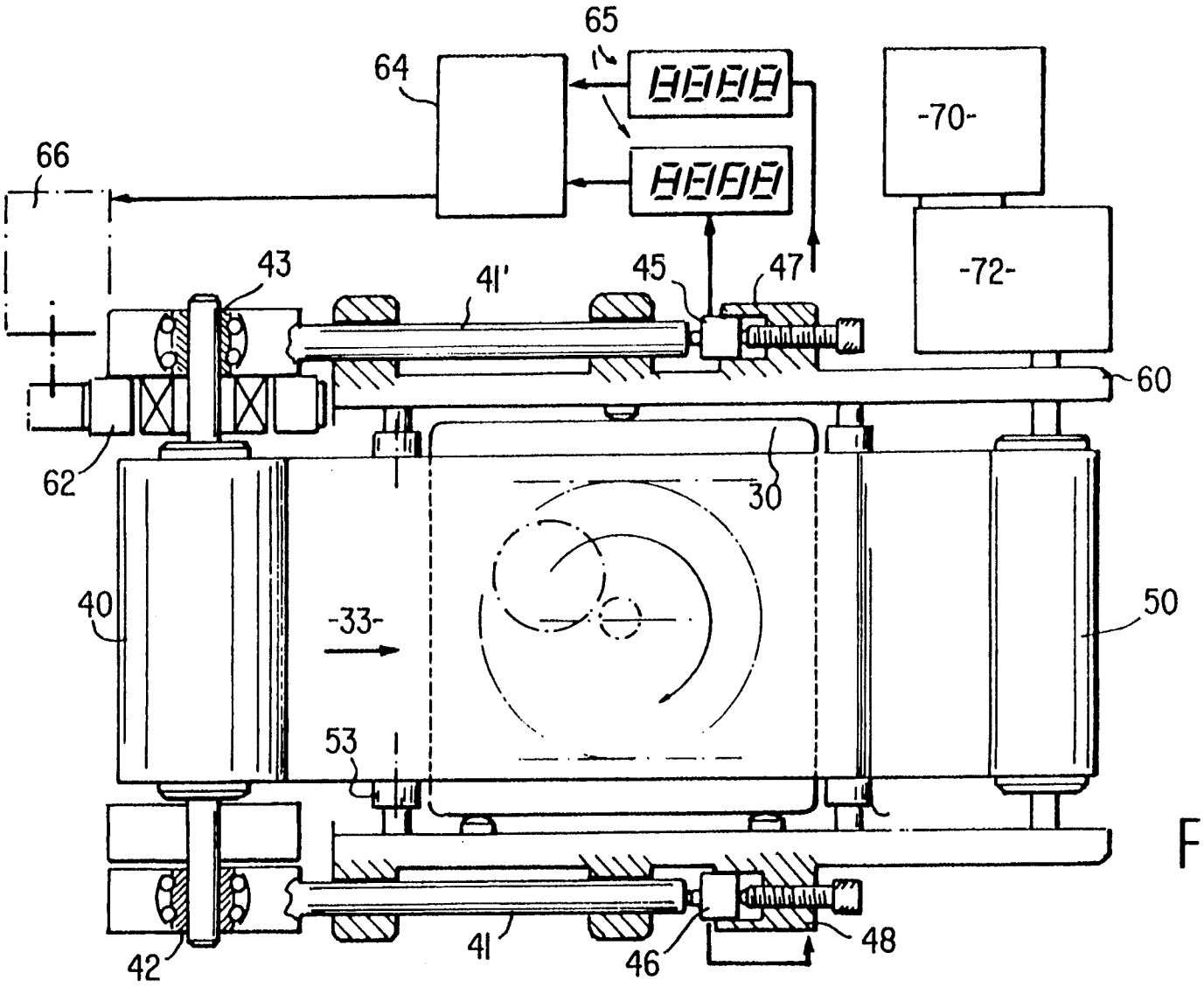
FIGS. 8*a* and 8*b* (Respectively in plan view and side view) a polishing machine according to the invention.
Figure 8B:
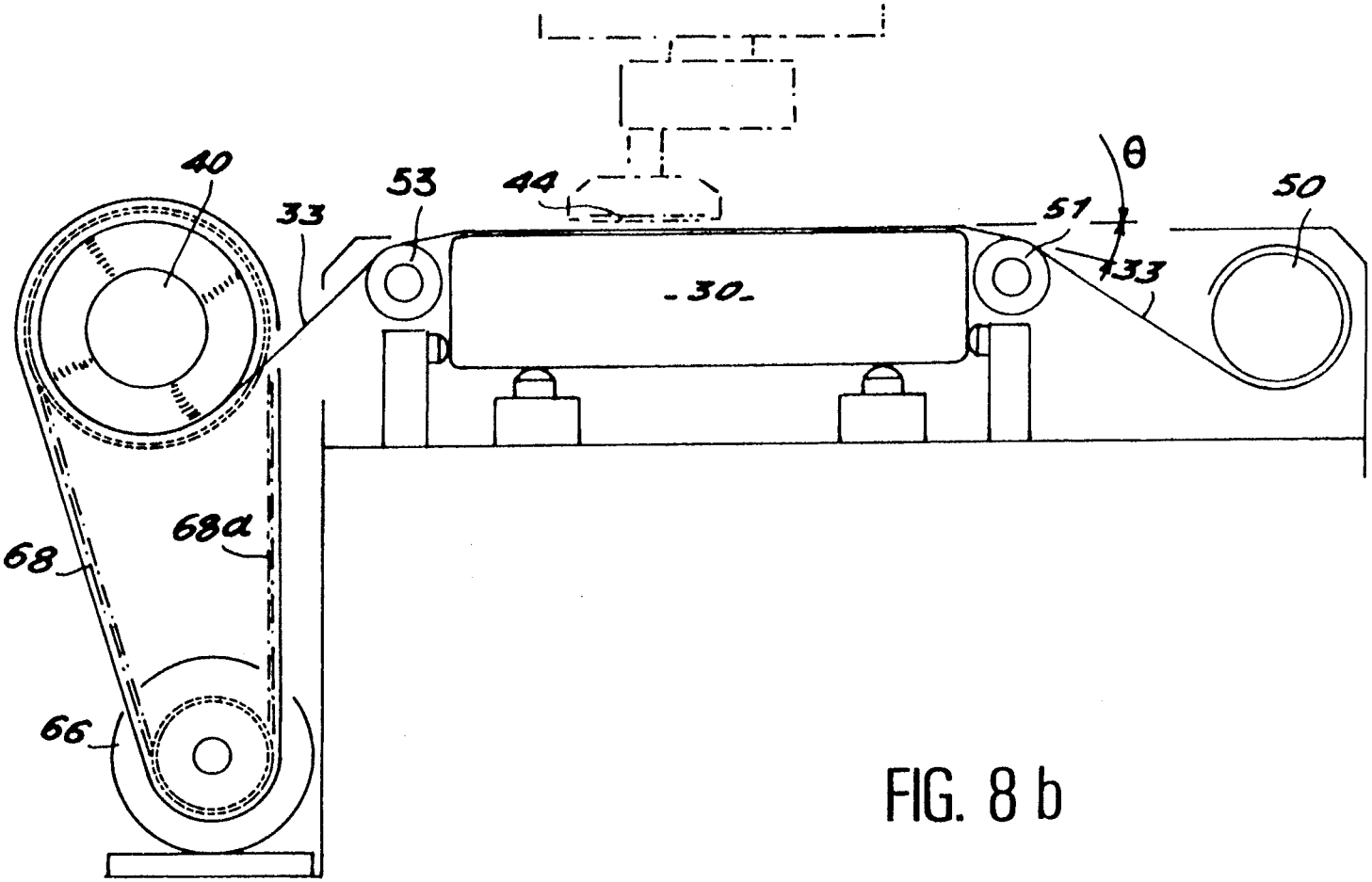

FIGS. 8*a* and 8*b* illustrate an embodiment of the means 35, 35' for keeping appropriately taut the abrasive sheet and for permitting the slow movement thereof over the disk. In the drawings, the machine is shown in plan view in part a and in side view in part b.

For simplification reasons, in connection with the machine shown it does not have a support for the wafers to be polished, or eccentric, or rotary pin, etc. FIGS. 8*a* and 8*b* relate to the reference disk and to the various means for keeping taut on the disk the microabrasive strip and for the movement thereof. The machine comprises a first roll 40 and a second roll arranged on either side of the reference disk 30. Onto the rolls is wound a microabrasive strip 33, which is consequently taut between the two rolls.

The first roll 40 is a delivery roll equipped with means for exerting a resistant torque. The second roll 50 is a receiving roll controlled by a motor. Therefore the microabrasive strip 33 can pass from the first roll 40 to the second roll 50, passing above the reference disk 30, which makes it possible to replenish or renew the abrasive surface.

The two rolls 40, 50 are located below the upper face of the reference disk 30, two drums 53, 51 being positioned between the rolls and the disk 30. The microabrasive strip 33 passes onto these drums 53, 51 on leaving the delivery roll 40 and on entering the receiving roll 50. These drums are preferably positioned slightly below the upper face of the disk 30, so that the microabrasive strip 33 forms a small angle $\theta$ with the horizontal on entering and leaving the disk, which improves its contact with the latter.

In the illustrated variant, the delivery roll 40 is connected to a frame 60 by two swivel bearings 42, 43 and two slides 41', 41, whose ends bear on two pressure transducers 45, 46 connected to the frame by two regulatable abutments 47, 48. The regulation of the abutments makes it possible to balance the tension of the strip over its entire width.

The means for exerting a resistant torque on the delivery roll 40 can be constituted, in a first variant, by an annular motor 62 mounted directly on one of the bearings 42 or 43, at the end of the slide 41'. Control means 64 for the motor are also provided. In a second variant, these means are constituted by a motor 66 separated from the delivery roll 40 and by a transmission belt 68 between the motor 66 and the roll 40. The taut side **68*a* of the belt 68 is in a plane perpendicular to the slides 41', 41. Means 64** for controlling this motor are also provided.

Moreover, the two pressure transducers 45, 46 located at the ends of the two slides 41', 41 are connected to the control means 64 of the motor 62 or 66 exerting a resistant torque on the delivery roll 40.

The receiving roll 50 is control led in rotation by a geared motor. This roll can be connected to the geared motor 70 by a transmission interruption means 72, such as a mechanical coupling or an electromagnetic clutch.

A more detailed description will now be given of the structure and functions of the sample support head, which cooperates with the taut microabrasive strip in order to permit a polishing under the conditions defined hereinbefore.

Figure 9A:
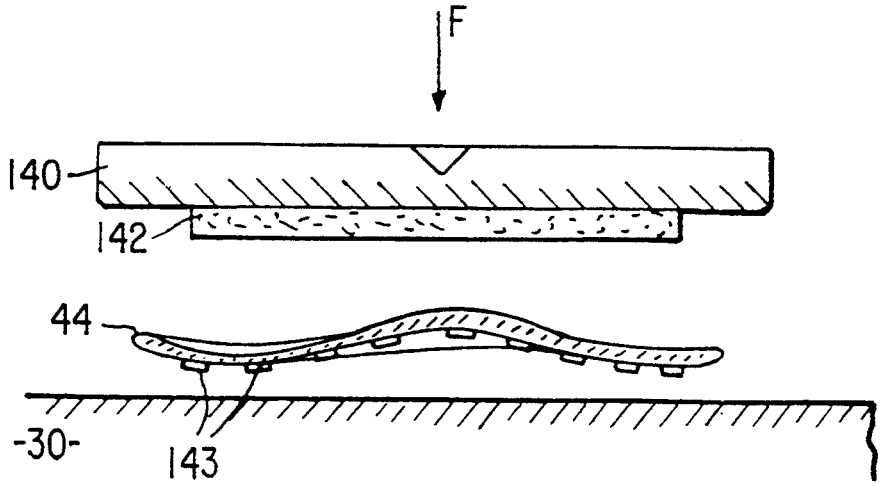
FIG. 9*a*, 9*b* and 9*c* Three positions (a, b, c) of the support head and illustrating the distribution of the force exerted.
Figure 9B:
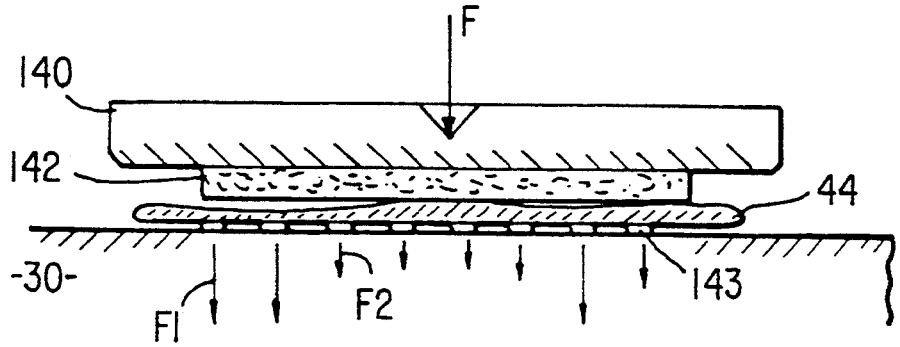
Figure 9C:
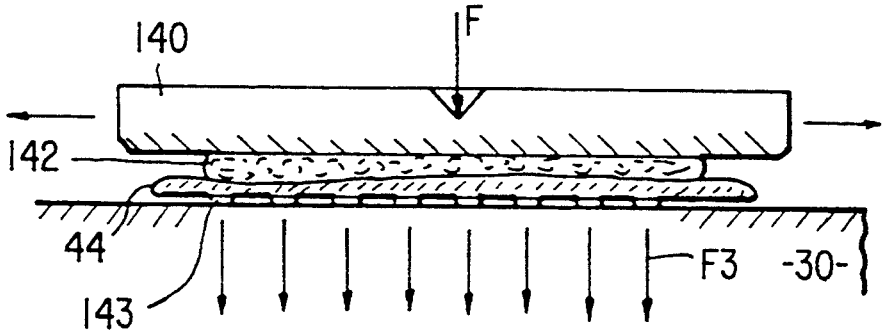

As shown in FIG. 7, the sample carrying head comprises a flexible disk 142, whose function is illustrated in FIG. 9. In FIG. 9, it is possible to see in part a, the support head freed from the wafer 44 to be polished, which has been shown with a very exaggerated deformation in order to clearly demonstrate the functions which will be fulfilled by the flexible disk 142. The reliefs to be polished are designated 143.

The force F vertically applied to the rigid part 140 has the effect of engaging the assembly on the polishing disk 30, the relief patterns 143 bearing on said plane (part b). However, as a result of the initial wafer deformation, the bearing force of these reliefs on the polishing disk 30 is not equally distributed. Thus, there are relatively high forces F1 at the periphery and relatively low forces F2 in the center in the illustrated example.

The application of a greater force to the rigid part 140 has the effect of making the wafer 44 penetrate the flexible disk 142 (part c). The penetration adapts to the initial deformation of the wafer and permits the compensation thereof. The force F3 exerted by each relief on the polishing plane is then substantially the same over the entire surface of the polishing plane.

Under these conditions, the force or load exerted on the wafer fulfils the two functions of making the main face of the wafer adopt the geometry of the reference plane, no matter what the initial deformation and thickness defects of the wafer and to obtain on each excrescence an adequate pressure to enable an effective and optimum material removal for a given displacement speed.

Once the wafer has been applied to the microabrasive film, the support is moved relative to the grinding plane, in accordance with a circular translation (rotation of the center of the plate around a point located in the grinding plane, the wafer still maintaining the same orientation). Thus, each excrescence has the same linear speed, no matter what its position on the plate.

In the configuration described hereinbefore, each excrescence receives a load proportional to its height. Then, after partial levelling, all the excrescences receive an identical load. It is therefore possible to consider that the contact is correct level with each projection. In addition, when the height of the projections decreases, the distance separating the main plane of the wafer and the grinding plane decreases. As the contact between two planes is never perfect, phenomena due to the viscosity of the air appear and Lend to bring about a partial separation of the plate. IL is therefore necessary to decrease the displacement speed and/or increase the pressure exerted on the wafer support.

The removal of material according to the invention excludes the use of any particle draining or cooling liquid. Thus, work takes place "dry". If necessary, a vacuum can be formed in the working area, or the air can be replaced by a light gas such as helium.

The determination of the characteristics of the flexible disk to be used according to the invention firstly relates to the minimum force or load Po to be exerted on the wafer in order to make the geometry of the front face adapt to the reference plane.

In the case of a homogeneous deformation of the spherical cap-shaped wafer, it is a question of bending the wafer in such a way that the stress resulting from the force cancels out the sag F.

The laws of the resistance of materials gives for Po:

$$Po=(3\pi Ee^3f)/5\ r^2$$

in which E is the modulus of elasticity (or Young's modulus) of the material forming the wafer, Po is a punctiform load applied to the center of the wafer (apex of the convexity), the wafer bearing on its circumference, e is the average thickness of the wafer and r is the wafer radius.

The load Po applied to the wafer will be distributed in a completely heterogeneous manner. Thus, said load will be concentrated in the center, the wafer edges scarcely coming into contact with the reference plane without the transmission of forces.

In the case of complex deformations, a good approximation consists of taking into account the relief which it is most difficult to bring into contact with the reference plane using the above formula. This determination amounts to comparing the ratios $f/r^2$ in a zone of radius r affected by the sag. Once the maximum ratio has been determined, the force necessary for recovering the deformation is applied to the complete surface of the flexible disk.

It is then a question of determining the admissible force distribution deviation. This is a compromise between the maximum homogeneity and the maximum value of the pressure admissible by the abrasive for given reliefs (risk of deterioration of the abrasive surface or the reliefs). It is generally considered that a 5 to 10 % deviation is acceptable. A value P1 equal,to 10 to 20 times the value Po, calculated in the aforementioned manner, is taken as the maximum force.

Figure 10:
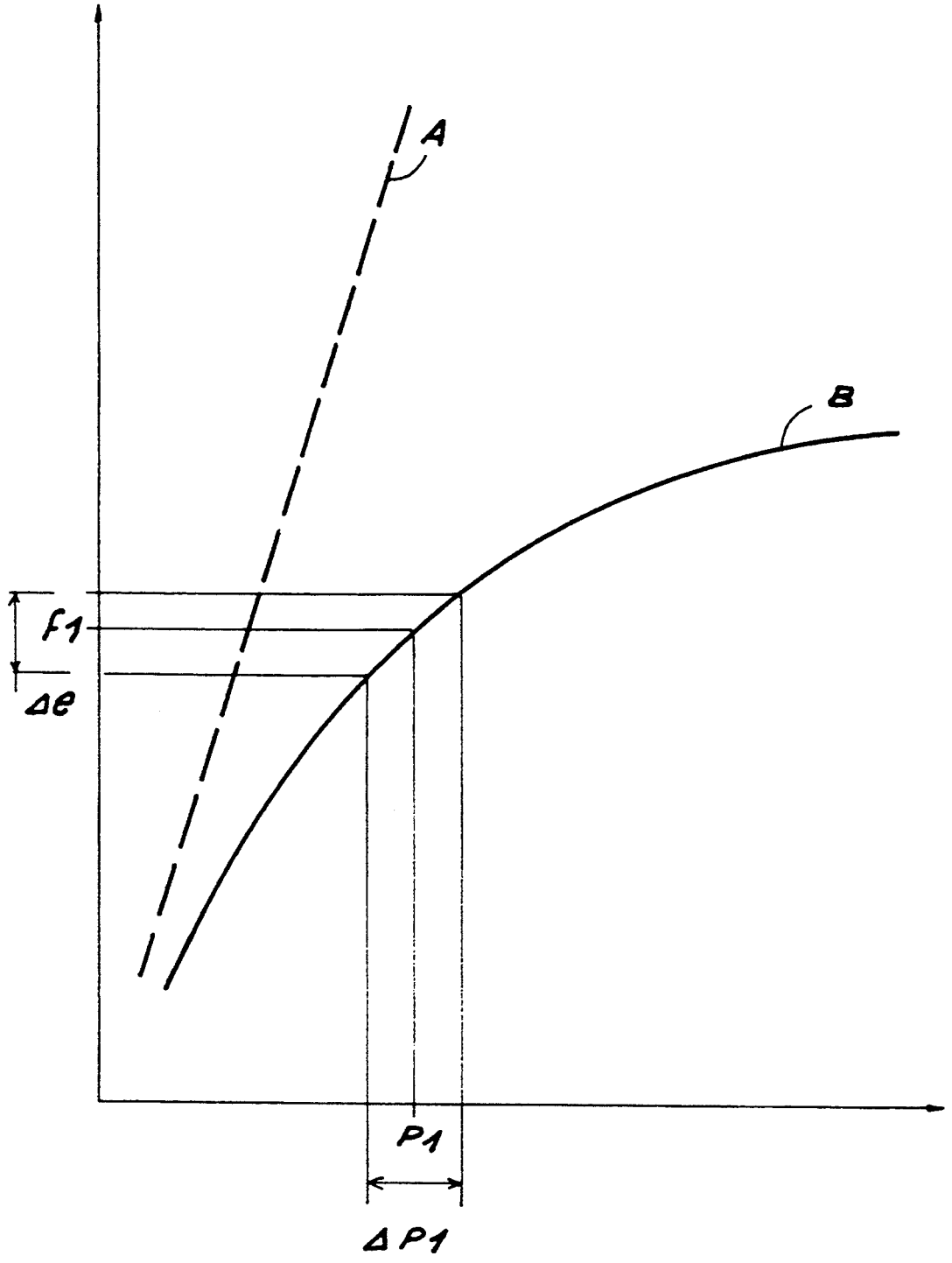
FIG. 10 A curve showing the variations of the embedding of the wafer in the flexible disk as a function of the force exerted on the support head.

Finally, it is possible to determine the characteristics of the disk. The curve of FIG. 10 shows the embedding (ordinate) as a function of the pressure (abscissa), the load being assumed as distributed over a unitary surface.

The line A does not Lake account of the finite thickness of the disk (in other words it assumes an infinite thickness). The curve B takes account of the thickness. A finite thickness leads to a "heeling out" of the material constituting the disk (generally an elastomer).

The load P1 gives the value of the pressure on the unitary surface used for plotting the curve. This value is transferred to the curve to obtain the corresponding sag, i.e. f1. The embedding of the flexible material varies as a function of the wafer thickness. The load P1 leads to a local pressure proportional to the thickness of the plate at a given point.

There is a transfer to the ordinate axis of the value of the maximum deviation on the thickness of the plate $\Delta e$ by centering it on F1. This gives the maximum variation $\Delta P1$ due to the variation $\Delta e$ around P1.

It is then checked that P1 remains compatible with the chosen 5 to 10% homogeneity or uniformity. If this value is exceeded it is possible to increase the flexible disk thickness, on approaching the horizontal zone of the curve, or increase its flexibility and therefore seek a new curve, on being well removed from the heeling out.

It is not desirable to work at the bottom of the curve, the contact between the flexible disk and the plate not being ensured at all points.

Embedding or penetration variations of the flexible disk can be due to different causes such as the variable thickness of the flexible disk, poor planeity of the support on which the disk is bonded and poor bonding or adhesion of the disk to its support. These variations must be maintained within the 5 to 10% threshold already taken into account.

The mechanisms referred to hereinbefore in connection with the determination of the minimum pressure and the flexible support are involved in the regulation of the flexible disk. Thus, if the excrescences to be levelled have variable heights, the highest ones will initially receive most of the force P1. In this area the plate will be subject to a sag, which will be compensated at the flexible material by a supplementary embedding or penetration effect, which will amount to an increase in the pressure in the area. Therefore this point will be ground more rapidly than the others.

Different embodiments of the wafer support will now be described in conjunction with FIGS. 11 to 13.

Figure 11:
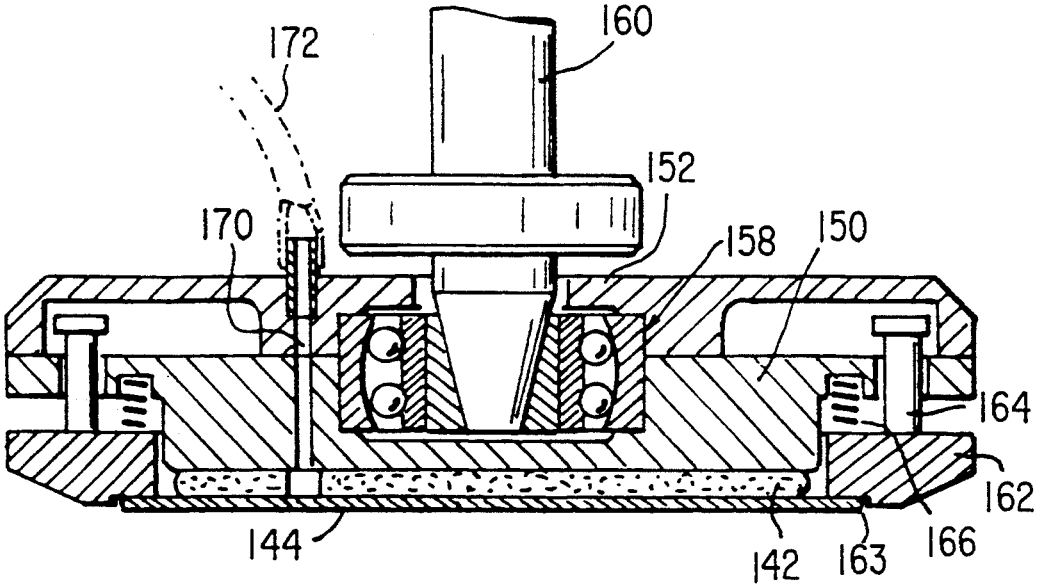
FIG. 11 In section, an embodiment of the support head.

The support shown in FIG. 11 comprises a two-part rigid body 150–152 on which is supported the flexible disk 142, as well as a device 158 allowing three rotations in accordance with three perpendicular axes, two of the rotations, used for positioning and correctly orienting the wafer 44 on the reference plane, possibly being of a partial nature or of limited amplitude, whereas the third is complete in accordance with an axis perpendicular to the reference plane. The device 158 permits the connection to a vertical shaft 160. The device is preferably a swivel bearing or needle bearing associated with a ball. The rigid body 150 is surrounded by a peripheral ring 162, in which has been made an interruption or break 163, whose height is less than the thickness of the wafer and whose diameter slightly exceeds that of the wafer. The wafer 44 is supported in the said break 163. The ring-like part 162 is connected to the rigid body 150 by small columns 164 and springs 166.

The vertical force applied to the shaft 160 does not pass through the peripheral ring 162, instead passing through the ball 158, the rigid body 150 and the disk 142. The ring 162 only serves to move the wafer 44 in the circular translatory movement necessary for polishing and which is produced by the horizontal drive force of the support (e.g. produced by the eccentric 37 of FIG. 7).

The rigid body 150–152 is perforated by a channel 170 connected by a tube 172 to a not shown vacuumizing machine. This arrangement makes it possible to maintain the wafer 44 in place during the phases where the support is not engaged on the polishing plane.

Figure 12:
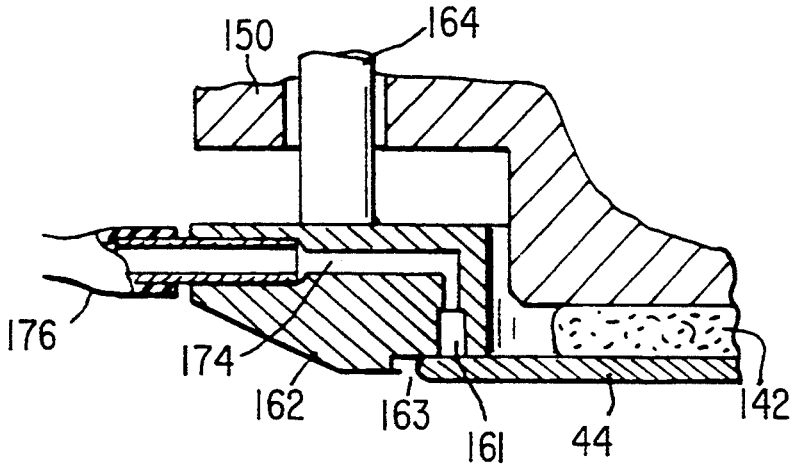
FIG. 12 A detail of a peripheral ring.

FIG. 12 shows a detail of the peripheral ring 162 with it break 163 receiving the wafer 44. In the illustrated variant, it is the ring 162, to which is added a circular groove 161, which is perforated by a channel 174 connected by a very flexible tube 176 to a not shown vacuumizing machine. This variant corresponds to polishing operations requiring higher torque forces than in the case of FIG. 11.

Figure 13:
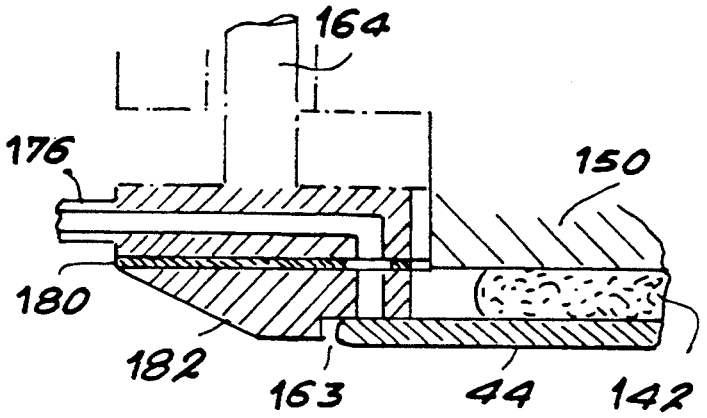
FIG. 13 An embodiment of the peripheral ring.

In the variant illustrated in FIG. 13, the peripheral ring is constituted by a thin ring 180 e.g. cut from a steel sheet, the thin ring being rigid in its plane, but flexible in the perpendicular direction. This thin ring 180 is coated with a very flexible material 182, e.g. silicone. Such an annular member is sufficiently rigid in the horizontal plane to transmit cutting forces, while being sufficiently vertically flexible to adapt to wafer defects.

With the polishing machine described hereinbefore, the Applicant has obtained the remarkable results illustrated in FIGS. 14 to 17.

Figure 1:
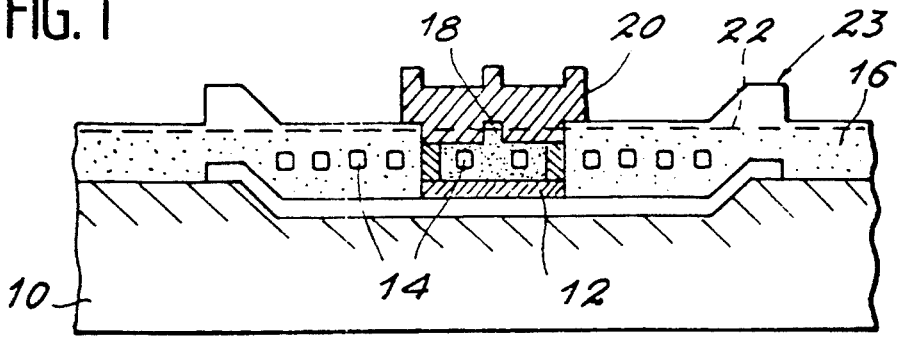
FIG. 1 Already described, an example of a part to be polished corresponding to a magnetic read-write head.
Figure 14:
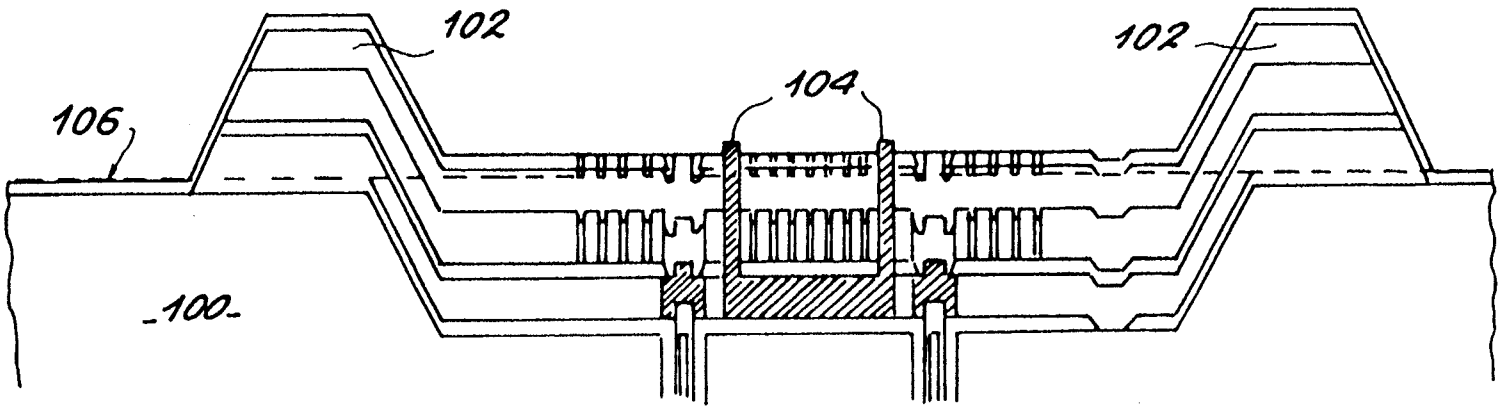
FIG. 14 An intermediate subassembly in the prediction of a magnetic read-write head.

FIG. 14 shows in section a subassembly corresponding to a horizontal magnetic read-write head of the type referred to in connection with FIG. 1. The subassembly of FIG. 14 essentially comprises a silicon substrate 100, two silica recess edges 102 and two iron-nickel vertical studs 104. It is a question of polishing this subassembly along a plane 106 before carrying out the upper pole piece formation operations.

Figure 15:
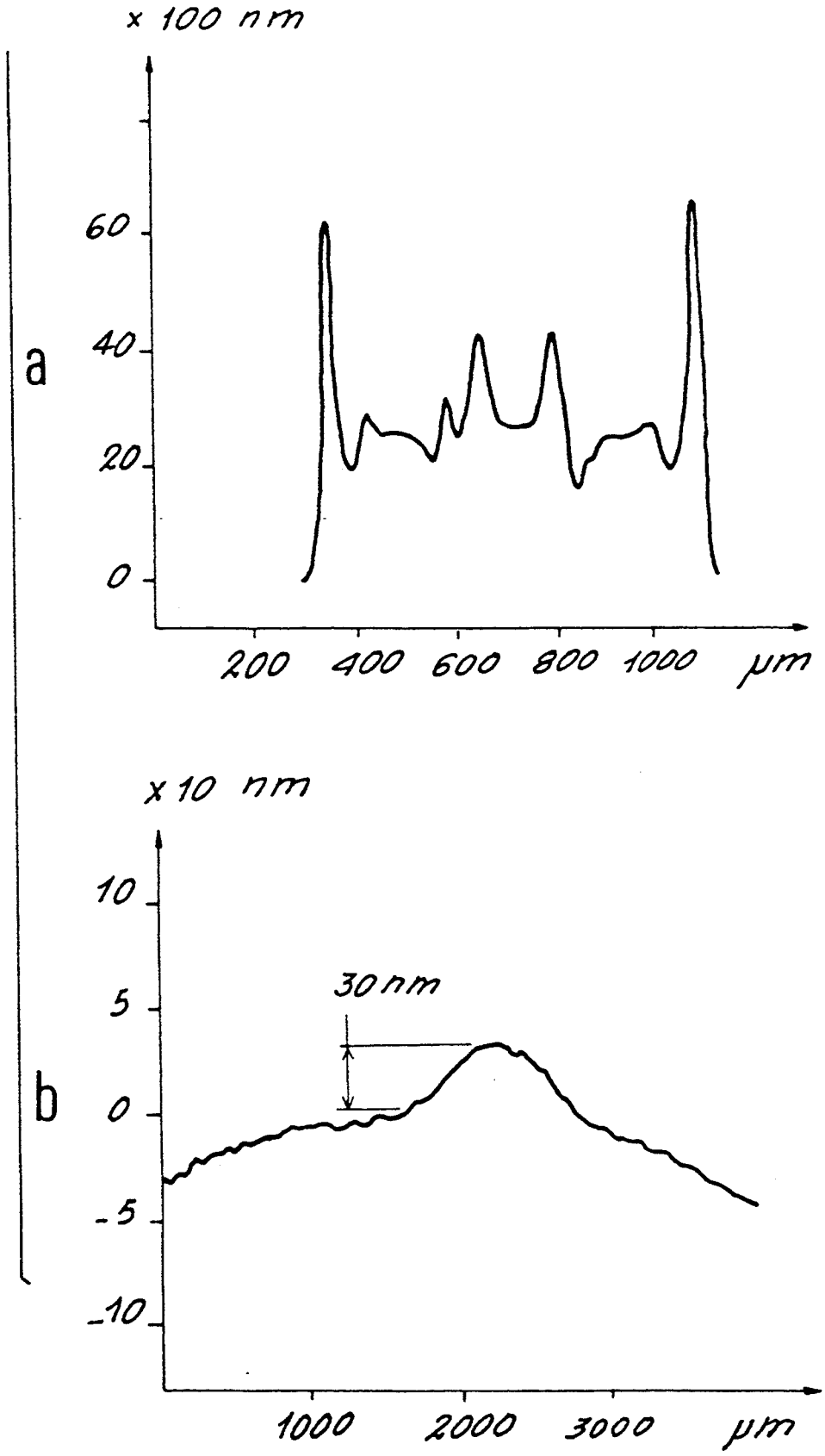
FIG. 15 The profile of said subassembly before and after polishing.

Prior to polishing, the profile of the subassembly is shown in part a of FIG. 15. On the abscissa is shown the entire raised interval of 1.2 mm (i.e. the units shown are in micrometers) and on the ordinate the units are in hundreds of nanometers. It is possible to see the two edges of the recess and in the center the two iron-nickel vertical studs.

After polishing, the profile assumes the shape of part b in FIG.. 15. The entire raised interval is 4 mm, so that it applies to the entire "ski" carrying the head. On the ordinate, the scale is in lens of nanometers. The residual projection in the natural curvature of the "ski" is equal to or less than 30 nm (said curvature being a fraction of the deformation of the substrate).

Figure 16:
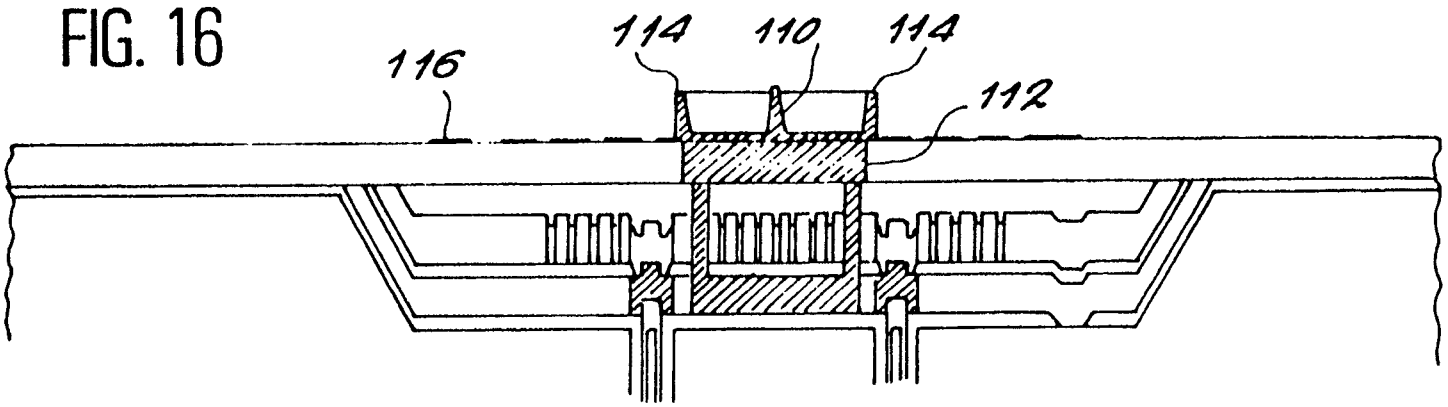
FIG. 16 The finished magnetic head.

FIG. 16 shows the head following the operations of forming the amagnetic spacer 110 and upper pole pieces 112 made from iron-nickel. Reliefs 114 appear in the center of the head. The final polishing plane is designated 116.

Figure 17:
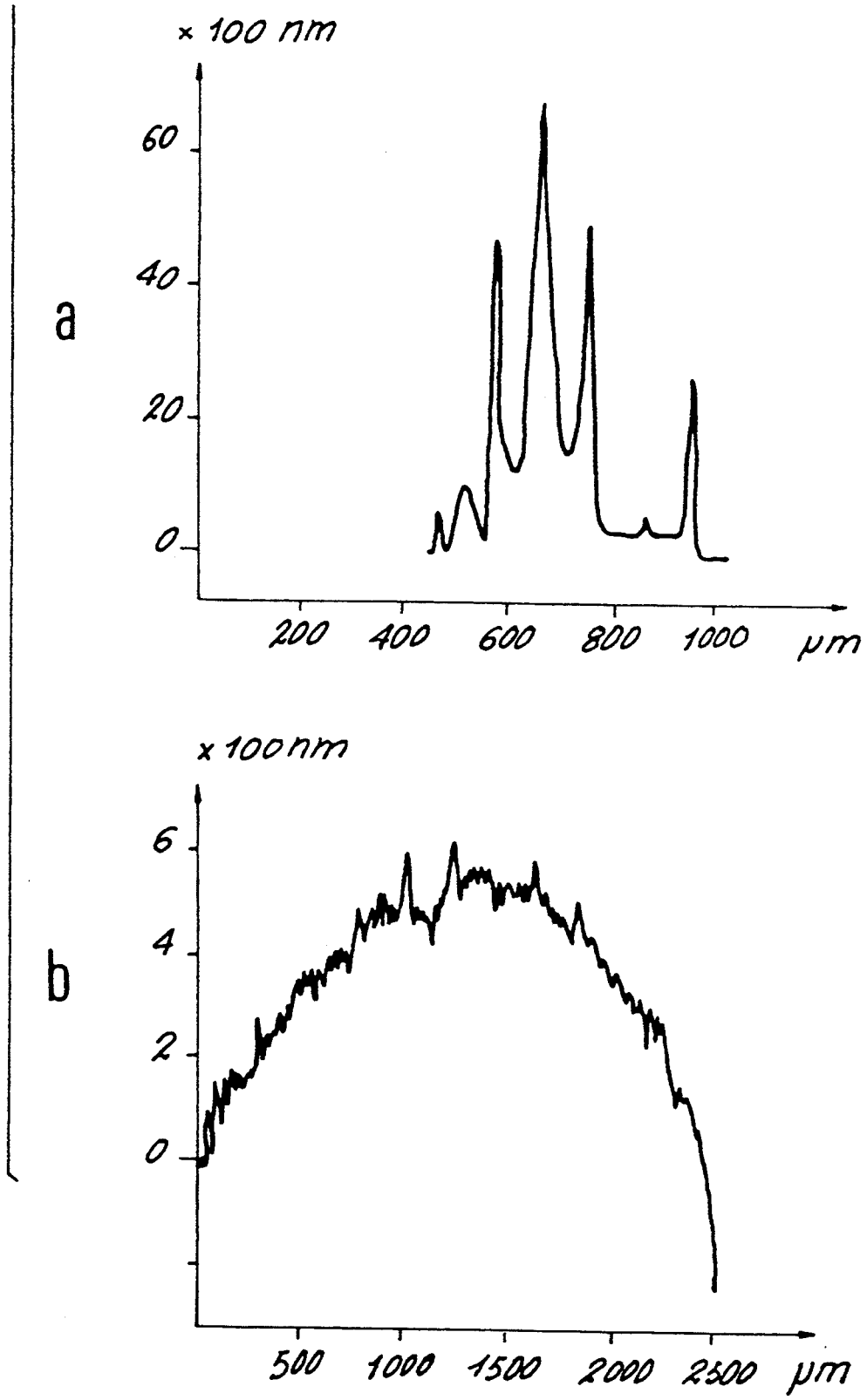
FIG. 17 The profile of said head before and after polishing.

In part a of FIG. 17 it is possible to see the profile of the subassembly before grinding. The units are the same as for FIG. 15*a*: 1.2 mm for the entire abscissa axis and one hundreds of nanometers for the ordinate. The three peaks corresponding to the three reliefs of the pole pieces are clearly visible.

Part b of FIG. 17 shows the raised interval after polishing. On the abscissa, the units are again in micrometers and on the ordinate in tens of nanometers. There is no residual projection and measurement only takes place of the natural curvature of the shoe (the curvature being a fraction of the substrate deformation).

What is claimed is:

1. A polishing machine comprising: a taut microabrasive strip positioned above a rigid planar upper face of a fixed polishing disk between a delivery roll and a receiving roll, the delivery roll comprising means for exerting thereon a resistant torque, and the receiving roll being controlled by a motor;

a support head for supporting a sample to be polished with a face of the sample to be polished facing the abrasive strip, the sample support head comprising a rigid part and a flexible disk made from a flexible material having a certain thickness, said flexible disk being fixed to said rigid part and receiving said sample to be polished; and means for displacing the sample support head in a circular translatory movement, the rigid part of the sample support head being connected by a self-aligning bearing and a vertical shaft to said displacing means.

2. The machine according to claim 1, wherein the delivery roll is connected to a frame by two swivel bearings and two slides, the two slides each having ends which bear on two pressure transducers connected to the frame by two regulatable abutments the regulation of the abutments making it possible to balance a tension of the strip over its entire width.

3. The machine according to claim 2, wherein the means for exerting a resistant torque on the delivery roll comprise an annular motor directly mounted on one of the swivel bearings, and motor control means.

4. The machine according to claim 2, Wherein the means for exerting a resistant torque on the delivery roll comprise a motor separate from said delivery roll, a transmission belt between said motor and the delivery roll, and motor control means, said belt having a taut side in a plane perpendicular to the slides.

5. The machine according to claims 3 or 4, wherein the two pressure transducers located at the ends of the two slides are connected to the motor control means of the motor exerting a resistant torque on the delivery roll.

6. The machine according to claim 1, wherein the receiving roll is controlled in rotation by a geared motor.

7. The machine according to claim 6, wherein the receiving roll is connected to the geared motor by a transmission interruption means, such as a mechanical coupling or an electromagnetic clutch.

8. The machine according to claim 1, wherein the delivery roll and the receiving roll are positioned below the upper face of the polishing disk, two drums being placed between the rolls and the polishing disk, the microabrasive strip passing on said drums on leaving the delivery roll and on entering the receiving roll.

9. The machine according to claim 8, wherein the two drums are placed below the upper face of the polishing disk, the microabrasive strip on entering and leaving the disk forming an angle ($\theta$) relative to the horizontal.

10. The machine according to claim 1, wherein the rigid part of the support head is surrounded by a peripheral ring having a groove with a diameter slightly exceeding the diameter of the Sample to be polished and whose height is slightly less than a thickness of the sample to be polished, which then bears in the groove, said peripheral ring being connected to the rigid part of the wafer support by means able to transmit to the peripheral ring and therefore to the sample to be polished, forces linked with a transverse displacement of the support head relative to the microabrasive strip, a pressure exerted on the support head being transmitted to the sample to be polished by the rigid part and the flexible material disk.

11. The machine according to claim 10, wherein the peripheral ring is constituted by a planar thin ring, which is rigid in its plane, but flexible perpendicular to said plane and is flexibly molded around said thin ring 12. The machine according to claim 1, wherein the rigid part of the support head is perforated by a channel also traversing the flexible material disk, said channel being connected by a tube to a vacuumizing machine.

13. The machine according to claim 10, wherein the peripheral ring is perforated by a channel issuing into the groove where the sample to be polished bears, said channel being connected to a vacuumizing machine by a flexible tube.

14. The machine according to claim 1, wherein said sample to be polished is a semiconductor wafer.

* * * * *